US007104108B2

(12) United States Patent
Roche

(10) Patent No.: US 7,104,108 B2
(45) Date of Patent: Sep. 12, 2006

(54) DENT REPAIR SYSTEM AND METHOD

(76) Inventor: Ronald W. Roche, 5810 Flush Rd., St. George, KS (US) 66535

( * ) Notice: Subject to any disclaimer, the term of this patent is extended or adjusted under 35 U.S.C. 154(b) by 452 days.

(21) Appl. No.: 10/367,237

(22) Filed: Feb. 14, 2003

(65) Prior Publication Data

US 2004/0159141 A1 Aug. 19, 2004

(51) Int. Cl.
*B21J 13/08* (2006.01)
*B21J 13/03* (2006.01)

(52) U.S. Cl. ..... 72/458; 72/459; 72/478; 72/705

(58) Field of Classification Search ..... 72/457, 72/458, 459, 478, 479, 480, 705
See application file for complete search history.

(56) References Cited

U.S. PATENT DOCUMENTS 1,737,084 A * 11/1929 Hilstad ..... 72/458
2,485,489 A * 10/1949 Ferguson ..... 72/479
2,539,040 A * 1/1951 Sparhawk ..... 72/458
2,582,971 A * 1/1952 Dunmore ..... 342/125
2,600,723 A * 6/1952 Back ..... 72/412
2,776,587 A * 1/1957 Killius ..... 72/458
2,844,060 A * 7/1958 Hagerty et al. ..... 72/479
5,619,876 A * 4/1997 Choi ..... 72/37
6,883,264 B1 * 4/2005 Gimbel ..... 43/6

* cited by examiner

*Primary Examiner*—Ed Tolan
(74) *Attorney, Agent, or Firm*—Mark E. Brown

(57) ABSTRACT

A dent repair system includes a hammer apparatus comprising an elongated base member with proximate and distal ends. An elongated swing member with proximate and distal ends is pivotally mounted on the base member by a hinge assembly mounted on and pivotally connecting the members at their proximate ends. A tip is mounted on the base member distal end and an impact head is mounted on the swing member distal end. The swing member is movable between a splayed position with the impact head spaced from the base member distal end and a closed position with the impact head engaging the base member distal end. A pry bar apparatus includes primary, extension and handle sections. The primary section mounts a head assembly adapted for engaging and straightening a dent. A dent repair method includes the steps of straightening a dent with the hammer apparatus and with the pry bar apparatus.

5 Claims, 6 Drawing Sheets

DENT REPAIR SYSTEM AND METHOD

BACKGROUND OF THE INVENTION

1. Field of the Invention

The present invention relates generally to dent repair, and in particular to a system and method for paintless dent removal (PDR) and knockdown.

2. Description of the Related Art

Conventional dent repair involves placing fiberglass body putty in dents and sanding or grinding the resulting surface smooth and flush. Coats of primer and paint are then applied as needed to match a surrounding, existing finish. Various tools and materials are available for performing such dent repair procedures, including hammers and other impact tools for straightening damaged sheet metal.

Refinishing plays a significant role in much of the collision damage repair work done with conventional tools and techniques. It also accounts for a significant part of the cost of many conventional collision repair jobs.

Paintless dent removal ("PDR") techniques are becoming increasingly popular. A major advantage of such techniques is eliminating the refinishing step. Substantial savings in labor and material costs can thus be achieved. Another advantage relates to preserving the original finish, which is generally preferred for aesthetics. PDR is accomplished by either pushing out a concave dent from the inside or pushing in a convex dent from the outside. Either way a common problem relates to overcorrection, which is generally caused by the metal being stretched or expanded by the original damage. Thus, reverse "dents" or projections often result from PDR techniques.

The tools commonly used for initially straightening sheet metal damage include hammers, slaphammers and other impact tools for applying positive force. Suction devices are available for applying negative force. Both types of tools can leave deflections from overcompensation and undercompensation, which can necessitate additional repair procedures.

After a dent is initially straightened, force is often applied from the other side to correct an overcompensation. However, with conventional impact tools and suction devices the person performing the repair often finds himself or herself too close to the damage to accurately assess the results. Consequently, convex and concave deflections, which are unnoticed at close range, often become apparent when observed from a greater distance. Body shop personnel often "step back" to observe the results of PDR procedures from a vantage point where the entire panel can be observed. Dents, deflections and overcompensations are common, and often necessitate further straightening adjustments.

The system and method of the present invention address the aforementioned problems associated with PDR and other repair procedures.

BRIEF DESCRIPTION OF THE INVENTION

In the practice of one aspect of the present invention, a dent repair hammer apparatus comprises an elongated base member with proximate and distal ends. An elongated swing member with proximate and distal ends is pivotally mounted on the base member by a hinge assembly mounted on and pivotally connecting the members at their proximate ends. A tip is mounted on the base member distal end and an impact head is mounted on the swing member distal end. The swing member is movable between a splayed position with the impact head spaced from the base member distal end and a closed position with the impact head engaging the base member distal end.

BRIEF DESCRIPTION OF THE DRAWINGS

The drawings constitute a part of this specification and include exemplary embodiments of the present invention and illustrate various objects and features thereof.

DETAILED DESCRIPTION OF THE INVENTION

I. Introduction

Figure 1:
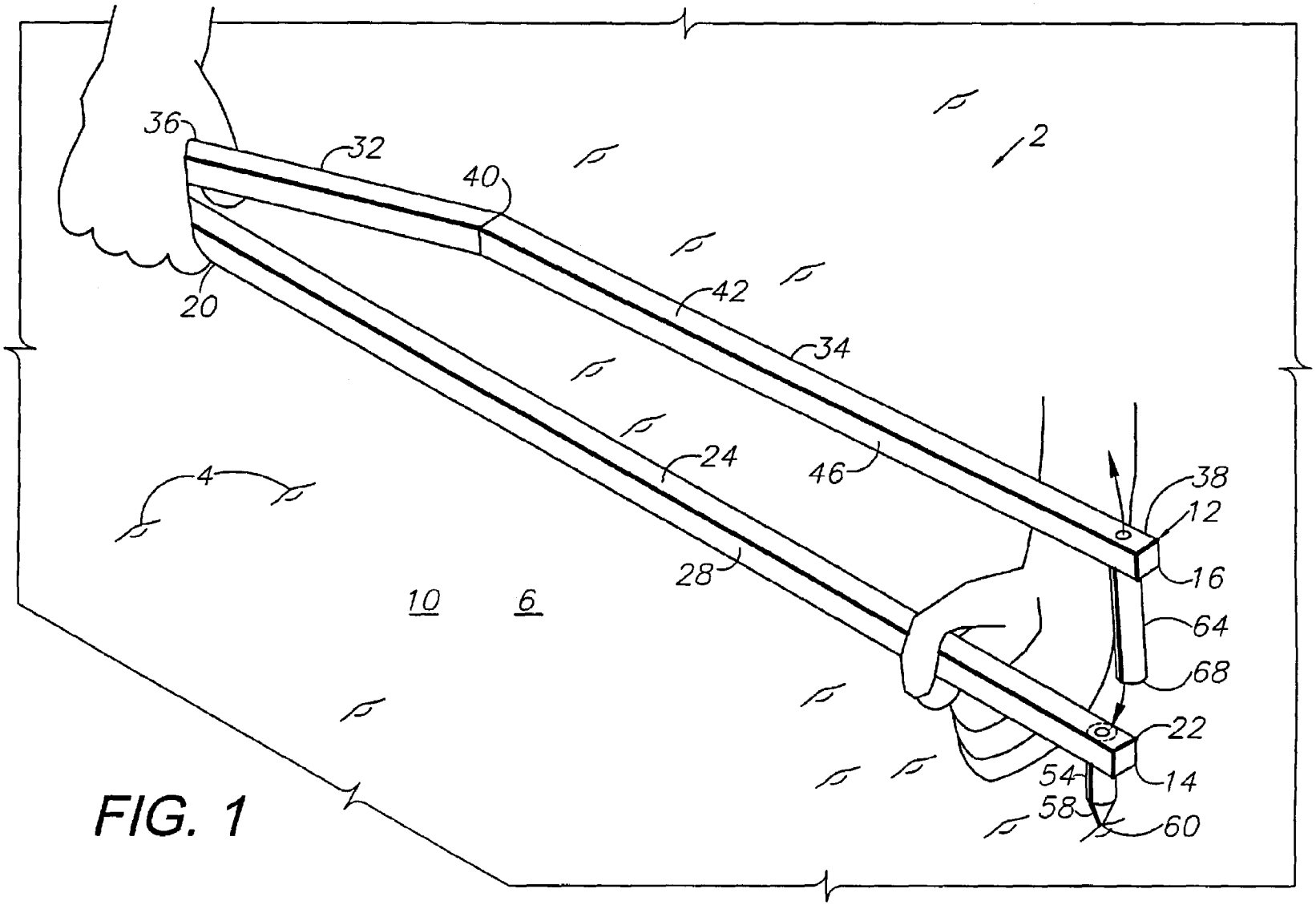
FIG. 1 is an upper perspective view of an embodiment or aspect of the invention, shown in use correcting dents in a vehicle body sheet metal panel with the base and swing members splayed.
Figure 2:
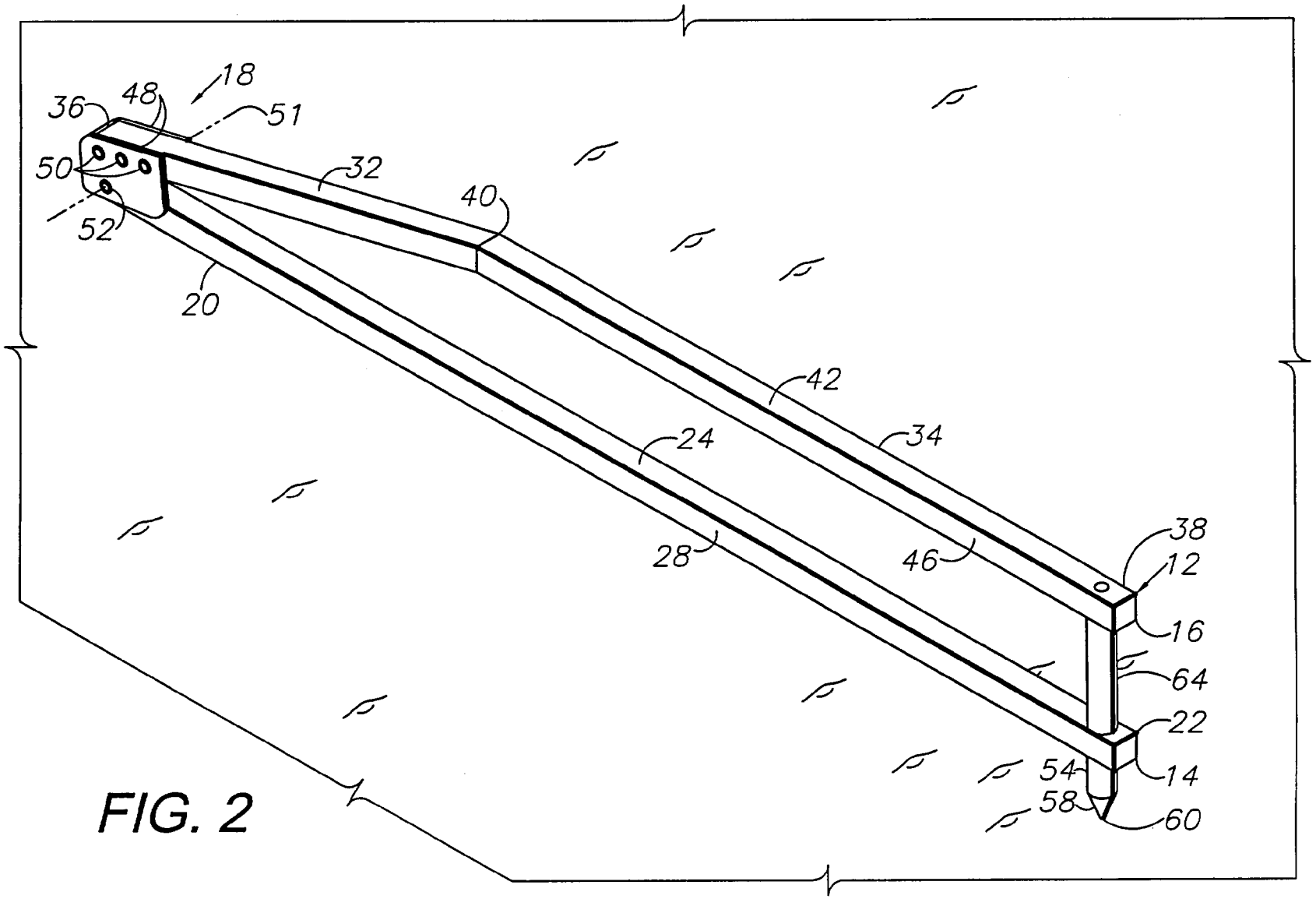
FIG. 2 is an upper perspective view showing the swing member impacting the base member.

As required, detailed embodiments and/or aspects of the present invention are disclosed herein; however, it is to be understood that the disclosed embodiments/aspects are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a dent removal system comprising an embodiment or aspect of the invention. Without limitation on the generality of useful applications of the system 2, a method comprising an embodiment or aspect of the invention is shown and described, which involves straightening dents 4 in a vehicle sheet metal body panel 6 with inner and outer surfaces 8, 10.

The system 2 generally comprises a hammer apparatus 12 and a pry bar apparatus 13.

II. Hammer Apparatus 12

The hammer apparatus 12 includes a base member 14, a swing member 16 and a hinge assembly 18 pivotally connecting the members 14 and 16. The base member 14 includes proximate and distal ends 20, 22; a top 24; a bottom 26; and opposite sides 28. A threaded receiver 30 extends between the base member top and bottom 24, 26 in proximity to its distal end 22.

The swing member 16 includes proximate and distal sections 32, 34 terminating at proximate and distal ends 36, 38 respectively. The sections 32, 34 form an obtuse angle at their junction 40 whereby the swing member 16 has a "dogleg" configuration. The swing member 16 further includes a top 42, a bottom 44, and opposite sides 46. A threaded receiver 47 extends between the base member top 42 and bottom 44 in proximity to its distal end 38.

Figures 3, 4:
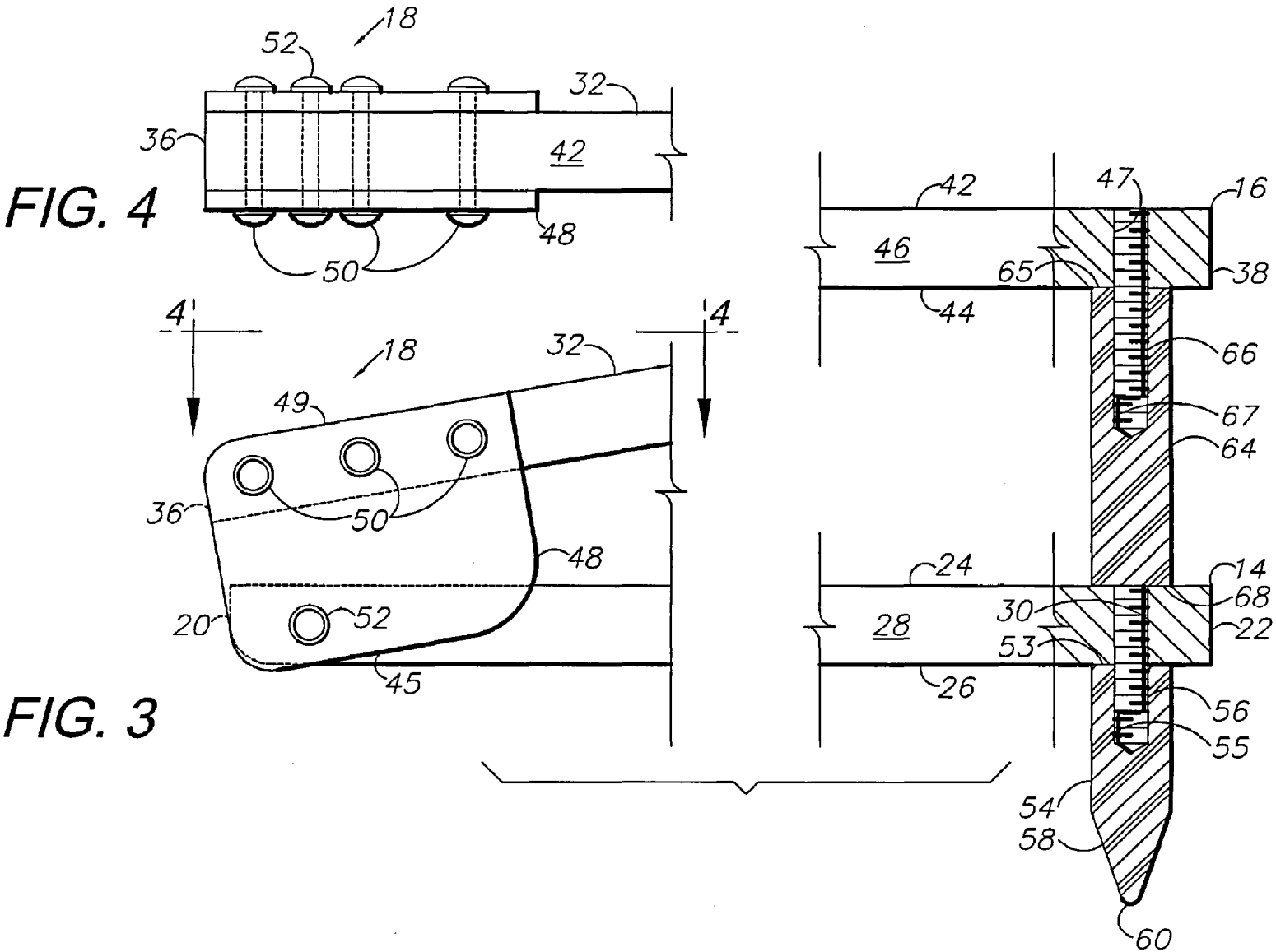
FIG. 3 is a fragmentary, side-elevational view, particularly showing a hinge assembly, an impact head and a tip.
FIG. 4 is a fragmentary, top plan view of the hinge assembly taken generally along line 4—4 in FIG. 3.

The hinge assembly 18 includes a pair of hinge plates 48 fixedly mounted on the swing member sides 46 by mechanical fasteners (e.g., three are shown) 50 (FIGS. 3 and 4) adjacent to respective swing member edges 49 of the hinge plates 48. Another mechanical faster 50 extends through the hinge plates 48 adjacent to respective hinge plate base member edges 45 thereof and through the base member 14 adjacent to its proximate end 20 and serves as a hinge pin defining a pivotal axis 51 about which the swing member 16 rotates with respect to the base member 14. The fasteners 50 and the hinge pin 52 can comprise rivets, bolts, machine screws or other suitable mechanical fasteners.

The base member 14 includes a tip 54 mounted at an attached end 53 thereof on the base member distal end 22 by a threaded stud 56 threadably received in the base member receiver 30 and in a tip axial receiver 55. The tip 54 depends downwardly from the base member bottom 26 and terminates at a tapered, frusto-conical free end 58 with a rounded apex 60 adapted for engaging a dent 4. The swing member 16 includes an impact head 64 mounted at an attached end 65 thereof on the swing member distal end 38 by a threaded stud 66 threadably received in the swing member receiver 47 and in an impact head axial receiver 67. The impact head 64 is generally cylindrical with a free end 68 positioned in spaced relation from the swing member distal end 38.

In operation, the hammer apparatus 12 can be oriented and held in various positions as necessary for placement of the tip 54 on a dent 4. FIG. 1 shows an example with the operator resting the heel and edge of his or her hand on the panel 6 and placing the base member 14 generally between his or her thumb and forefinger. The operator's other hand can be placed over the hinge assembly 18 for steadying the base member 14 and swinging the swing member 16. It will be appreciated that greater force can be achieved with longer swings and vice versa. For example, controlled, slight taps are sometimes all that is required for straightening the dents 4. By positioning his or her hands as shown in FIG. 1, the operator can observe the effects of the dent-removing procedure from several feet away. Thus, the overall effect of the procedure can be observed. Such a vantage point for observing the effects of the procedure can produce better results with less likelihood of the repairs being noticeable.

The components of the hammer apparatus 12 can comprise a suitable material(s). For example, the base and swing members 14, 16 can comprise square aluminum barstock with suitable dimensions, for example approximately one-half inch between the respective tops 24, 42 and bottoms 26, 44, and between the opposite sides 28, 46. Aluminum, hollow tubing and other configurations can be used to minimize the weight of the hammer apparatus 12. The tip 54 and the impact head 64 can comprise a suitable high impact plastic, such as Delrin® acetal from E. I. DuPont de Nemours and Co. of Wilmington, Del. , or some other suitable material. Alternatively, multiple tips 54 and impact heads 64 can be provided with different weights and materials for performing specific debt repair procedures.

III. Pry Bar Apparatus 13

The pry bar apparatus 13 is shown in FIGS. 5–8 and generally includes a primary section 70, an extension section 72 and a handle section 74. The primary section 70 generally comprises a hollow, square cross-sectional tube with a first end 76 adapted to receive either the extension section 72 or the handle section 74. A primary section second end 78 mounts a head assembly 80, which includes a shaft 82 with a bent leg 83 extending from a first face 87 and terminating at a pointed end 84 extending generally upwardly (as viewed in FIGS. 5–8) and forwardly from the primary section second end 78 whereby the primary section 70 forms an obtuse angle with respect to the shaft bent leg 83. The shaft 82 also includes a transverse leg 85, which can be welded in place in the primary section second end 78 (FIG. 8) and includes a male-threaded end portion 86, which protrudes outwardly from a second face 89 opposite from the bent leg 83.

The head assembly 80 also includes a foot 88 comprising a post 90 threadably receiving said shaft threaded end portion 86 for mounting on said primary section second end 78. The post 90 terminates at a ball 92, which pivotally mounts an elastomeric end cap 94. The end cap 94 is thus adapted for pivoting on the post 90 for relatively flat engagement against a respective sheet metal surface while the pivotal interconnection allows the pry bar 13 to assume various angular orientations.

Figure 7:
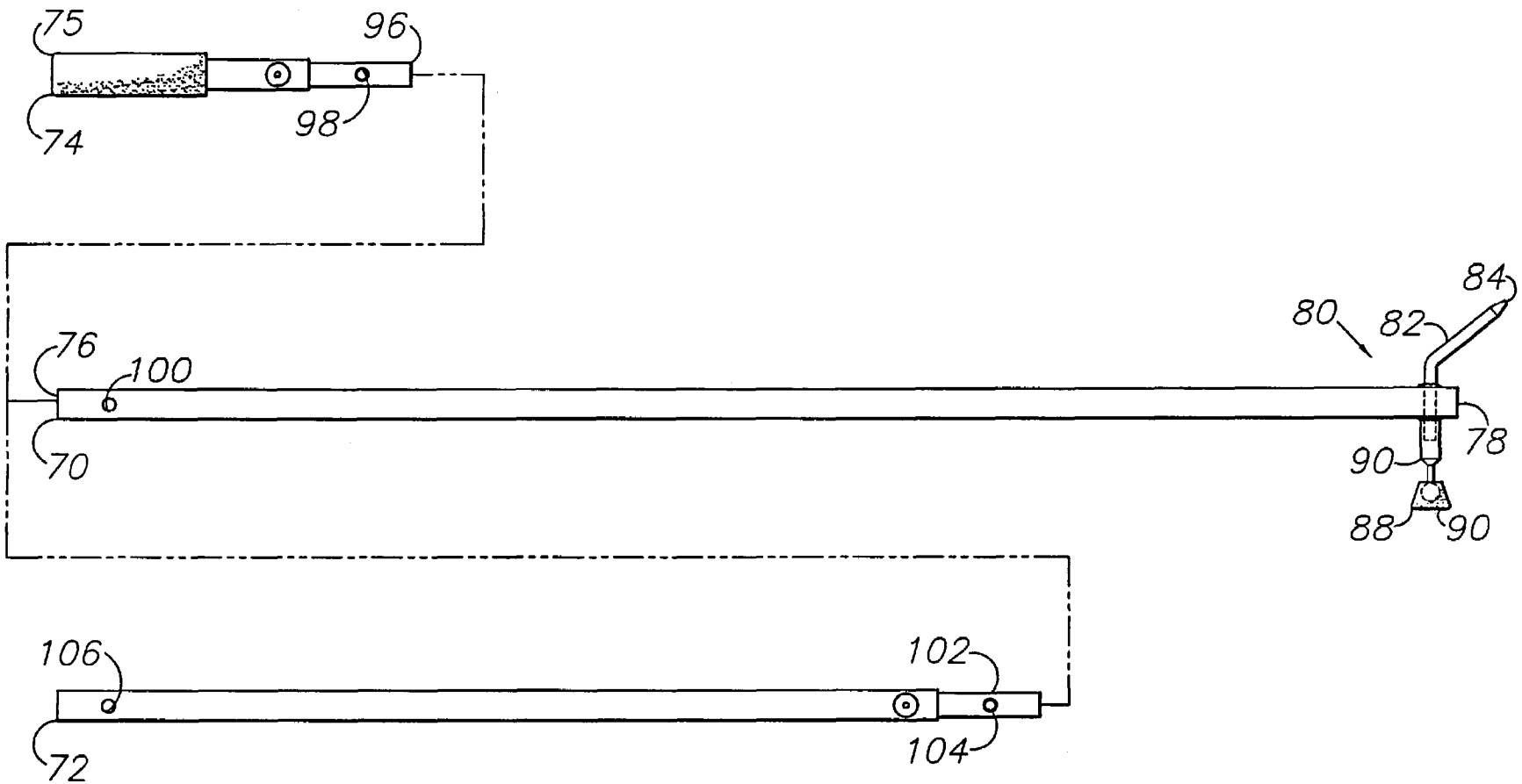
FIG. 7 is a side elevational view of the pry bar apparatus, shown with detached handle, primary and extension sections.
Figure 8:
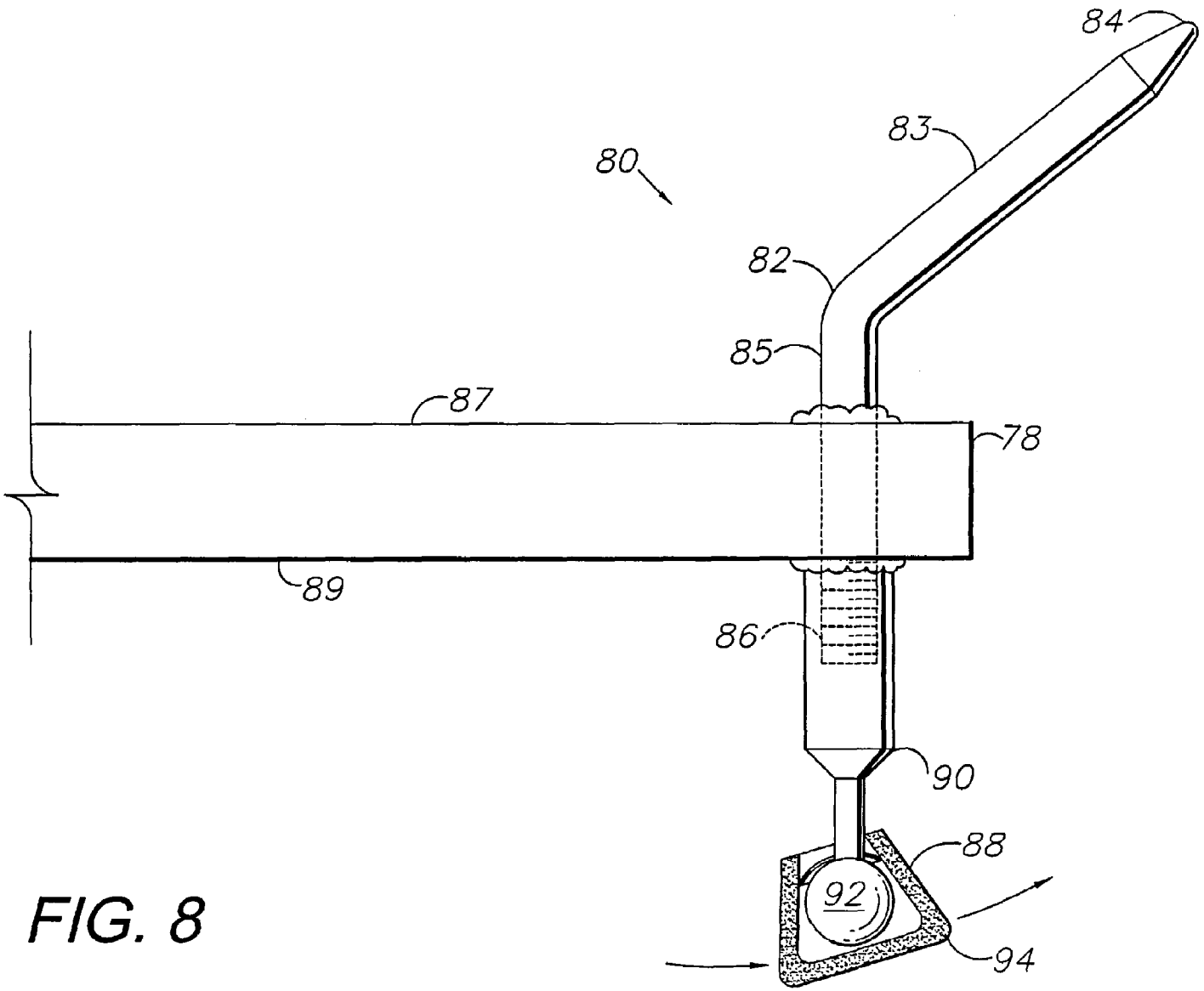
FIG. 8 is an enlarged, cross-sectional view of a head assembly of the pry bar apparatus, taken generally within circle 8 in FIG. 7.

The handle section 74 includes a handgrip 75 on one end, and on the other end includes an insert 96 adapted for telescopic insertion in the primary section first end 76. A spring-loaded plunger 98 is mounted on the handle section insert 96 and springs into a receiver 100 formed in the primary section 70 adjacent to its first end 76 for providing a releasable catch. The plunger 98 can be depressed and retracted by pushing on it from the outside, whereby the handle section 74 can be detached from the primary section 70. As shown in FIG. 7, the extension section 72 has a similar insert 102 with a similar spring-loaded plunger 104. The other end of the extension section 72 has a receiver 106, which can selectively receive the handle section plunger 98 when the primary, extension and handle sections 70, 72, 74 are secured together to provide extra leverage or to apply a straightening force at a distance of several feet.

Figure 5:
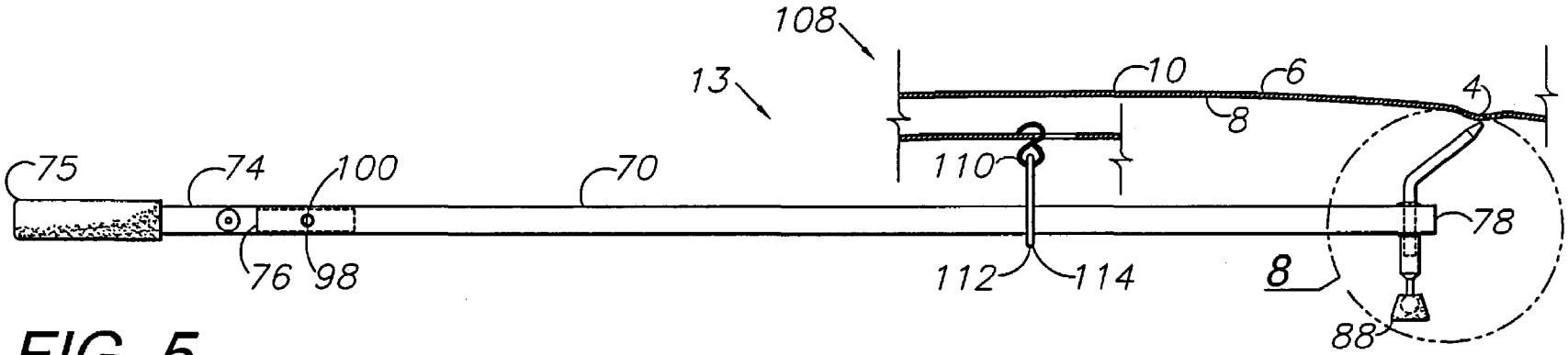
FIG. 5 is a side elevational view of a pry bar apparatus of the system, shown suspended from a vehicle roof structure and positioned for pushing out a concave dent.
Figure 6:
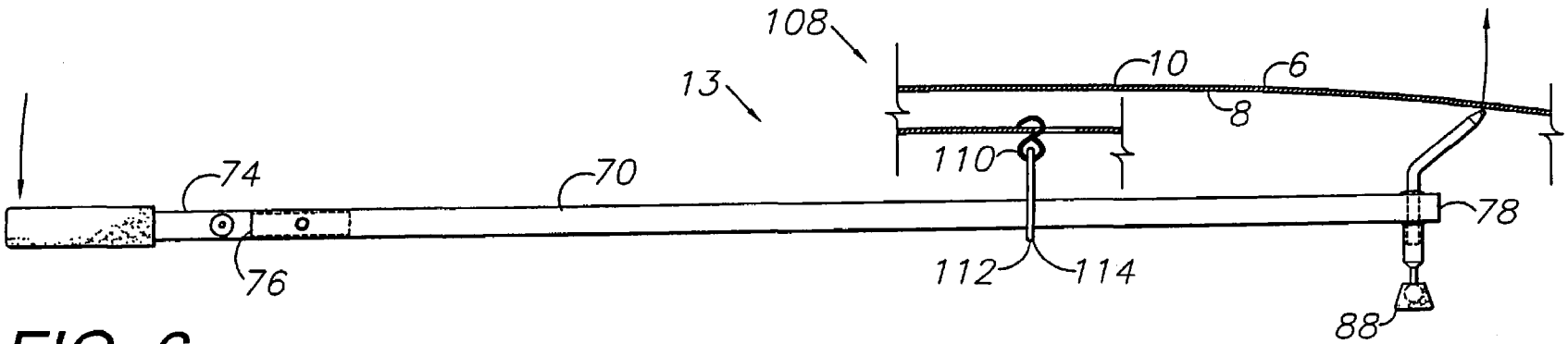
FIG. 6 is a side elevational view of the pry bar apparatus, shown with the dent straightened.

FIGS. 5 and 6 show the pry bar 13 straightening a dent 4 in a panel 6. The pry bar 13 is suspended from the roof structure 108 of the vehicle, which can be accessed by removing the headliner. An S-hook 110 is suspended from the roof structure 108 and supports a closed ring 112, through which the pry bar 13 slidably extends. The S-hook 110 and the ring 112 collectively comprise a fulcrum assembly 114. The ring 112 can be made in any suitable geometrical shape, including round, triangular, etc. The pry bar head assembly 80 can thus be located where needed for repair purposes. Relatively large, flat dents are often more easily straightened with the foot 88, which can be engaged by flipping the pry bar 13 over. With the optional, additional length provided by the extension section 72 and the handle 74, numerous configurations are possible with the pry bar 13 and damage in out-of-the-away places can be accommodated. Moreover, the pry bar 13 can be slid through the ring 112 and rotated as needed to properly position the head assembly 80.

It is to be understood that while certain embodiments and/or aspects of the invention have been shown and described, the invention is not limited thereto and encompasses various other embodiments/aspects.

What is claimed and desired to be secured by Letters Patent is as follows:

1. A system for removing dents from a vehicle panel with inner and outer surfaces, which system includes:

a hammer apparatus comprising: an elongated base member with proximate and distal ends; an elongated swing member with proximate and distal ends; a hinge assembly mounted on said member proximate ends and pivotally connecting said members thereat; a tip mounted on said base member distal end; and an impact head mounted on said swing member distal end;

said swing member being movable between a splayed position with said impact head spaced from said base member distal end and a closed position with said impact head engaging said base member distal end;

a pry bar apparatus comprising: an elongated bar with first and second ends; a head assembly mounted on said second end and adapted for engaging said panel inner surface; and a fulcrum assembly located between said ends and adapted for attachment to said vehicle;

said pry bar apparatus being adapted for pushing out a dent from the inside;

said hammer apparatus being adapted for straightening a dent inwardly from said panel outer surface;

said pry bar having a generally rectangular cross-sectional configuration with opposite first and second faces;

said head assembly including a shaft extending outwardly and forwardly from said pry bar first face;

said shaft including a bent leg with a pointed end adapted to engage said body panel; and said head assembly including a foot mounted on said shaft and extending from said second face, said foot being adapted for engaging said body panel.

2. The system according to claim 1 wherein:

said shaft includes a transverse leg extending transversely through said pry bar second end and including a threaded end portion protruding from said pry bar second face; and said foot includes: a post extending from said pry bar second face and including a threaded receiver threadably receiving said shaft threaded end portion; said post terminating at a ball; and an elastomeric end cap with a socket pivotally receiving said ball.

3. The system according to claim 1, wherein said pry bar apparatus includes:

said pry bar having a hollow, tubular configuration with a receiver located in proximity to its first end;

a pry bar handle section including an insert adapted to be telescopically received in said pry bar first end; and a spring-loaded plunger connected to and protruding outwardly from said handle section insert, said plunger being selectively received in said pry bar receiver with said insert inserted into said pry bar first end.

4. The system according to claim 3, which includes:

a pry bar extension section including an insert adapted to be telescopically received in said pry bar first end; and a spring-loaded plunger connected to and protruding outwardly from said extension section insert, said plunger being selectively received in said pry bar receiver with said insert inserted into said pry bar first end.

5. The system according to claim 1 wherein said fulcrum assembly comprises a ring slidably receiving said pry bar arid a hook connected to said ring and adapted for connection to the vehicle.

* * * * *